US005319884A

United States Patent [19]

Bergeron

[11] Patent Number: 5,319,884

[45] Date of Patent: Jun. 14, 1994

[54] BUCK FRAME AND WINDOW FRAME REMOVABLY FITTED THEREIN

[76] Inventor: Jean-Guy Bergeron, 192, rue Principale, Saint-Rosaire, Canada, G0Z 1K0

[21] Appl. No.: 987,771

[22] Filed: Dec. 9, 1992

Related U.S. Application Data

[63] Continuation-in-part of Ser. No. 779,848, Oct. 21, 1991, abandoned.

[51] Int. Cl.[5] ..... E06B 1/04

[52] U.S. Cl. ..... 49/504; 49/466; 52/209

[58] Field of Search ..... 49/463, 466, 504, 414, 49/419, 454, 453, 417, 418; 52/206, 207, 209, 213, 215

[56] References Cited

U.S. PATENT DOCUMENTS

| | | | |
|---|---|---|---|
| 1,640,595 | 8/1927 | Buss | 49/504 |
| 3,412,510 | 11/1968 | Harcuba | 49/466 X |
| 3,769,769 | 11/1973 | Kohl | 52/216 X |
| 4,112,645 | 9/1978 | Greenfield | 52/209 X |
| 4,281,477 | 8/1981 | Kaminaga | 49/453 |
| 4,430,831 | 2/1984 | Kemp | 49/504 X |
| 4,724,637 | 2/1988 | Evans | 52/209 |
| 4,740,405 | 4/1988 | Tanaka et al. | 49/504 X |
| 4,763,446 | 8/1988 | Kelly | 52/207 X |
| 4,799,332 | 1/1989 | Hass | 49/504 X |
| 4,831,781 | 5/1989 | Morton | 49/504 |
| 4,916,863 | 4/1990 | Burrows et al. | 49/454 X |
| 4,993,188 | 2/1991 | Erickson et al. | 49/454 X |
| 5,003,747 | 4/1991 | Morton | 52/209 |

FOREIGN PATENT DOCUMENTS

| | | | |
|---|---|---|---|
| 748189 | 12/1966 | Canada | 49/504 |

*Primary Examiner*—Peter M. Cuomo
*Assistant Examiner*—Jerry Redman
*Attorney, Agent, or Firm*—Pierre Lespérance; Francois Martineau

[57] ABSTRACT

The buck frame is in a one-piece construction and is designed to be embedded in a poured concrete wall. The exterior of the buck frame is provided with reinforcing ribs, while its interior surfaces form a centrally-located boss, the side faces of which are provided with lips and grooves to releasably retain a window frame, made of four separate interfitting parts. A resilient polyurethane board is fitted between the lintel part of the window frame and the registering boss of the buck frame to provide for installation and removal of the horizontally-slidable window panes and also of the window frame parts.

8 Claims, 4 Drawing Sheets

TOP
OUTSIDE 10
10

BUCK FRAME AND WINDOW FRAME REMOVABLY FITTED THEREIN

CROSS-REFERENCE DATA

This application is a Continuation-in-Part application of U.S. application Ser. No. 07/779,848 filed on Oct. 21, 1991 for WINDOW FRAME, now abandoned.

FIELD OF THE INVENTION

The present invention relates to a buck frame adapted to be embedded in a poured concrete wall, and to a window frame removably fitting within the buck frame.

BACKGROUND OF THE INVENTION

Installation of a window frame in the poured concrete foundation of a building, such as a house, has, up to now, required the construction of a wooden frame inserted in the concrete form and around which concrete was poured. After concrete curing, the wooden frame had to be removed and the conventional window frame fitted within the concrete wall aperture. The installation of such a basement window was therefore time-consuming.

It is known to provide buck frames to be permanently embedded in a poured concrete wall, for instance the buck frame described in U.S. Pat. No. 3,769,769 dated Nov. 6, 1973—inventor: William J. Kohl and entitled: PERMANENT BASEMENT WINDOW FRAME AND POURING BUCK. However, none of the known buck frames permit the installation and removal of a window frame of the type having a multiplicity of horizontally-slidable glass panes, with or without sashes.

OBJECTS OF THE INVENTION

It is therefore the main object of the present invention to provide a buck frame adapted to be permanently embedded in a poured concrete wall and provided with means for removably securing therein a window frame of the type having a plurality of horizontally-slidable window panes, such that, in the event of breakage of either a glass pane or a part of the window frame, the same can be removed and repaired and a new window component reinstalled.

Another object of the present invention is to provide a buck frame of the character described, of a single-piece construction, made of molded plastic, which is strong enough to resist the weight of the freshly-poured concrete, and which has anchor means to removably retain a window frame therein.

SUMMARY OF THE INVENTION

The quadrangular buck frame of the invention is in a one-piece molded construction, made entirely of rigid plastic material It defines an inner opening in which inwardly protrudes a boss of channel-shape cross-section, the sides of which are provided with lip-and-groove means for releasably anchoring a window frame. The four sides of the window frame are separate members, of U-shape cross-section, to fit over the respective bosses and have inturned hooking flanges engaging and retained by the lip-and-groove means. The window frame has several parallel tracks to receive a plurality of horizontally-slidable window panes. A band of compressible material is sandwiched between the bottom of the lintel member of the window frame and the registering boss of the buck frame. Said lintel member is first lifted against the bias of said compressible band, so that the window panes can be removed and then the jamb members of the window frame can then be removed and, finally, the lintel and sill member of the window frame can be removed. Preferably, the buck frame sill is provided with a plurality of draining troughs registering with holes made in the window frame sill member for draining away condensation water falling from the glass panes.

DETAILED DESCRIPTION OF THE INVENTION

Figure 1:
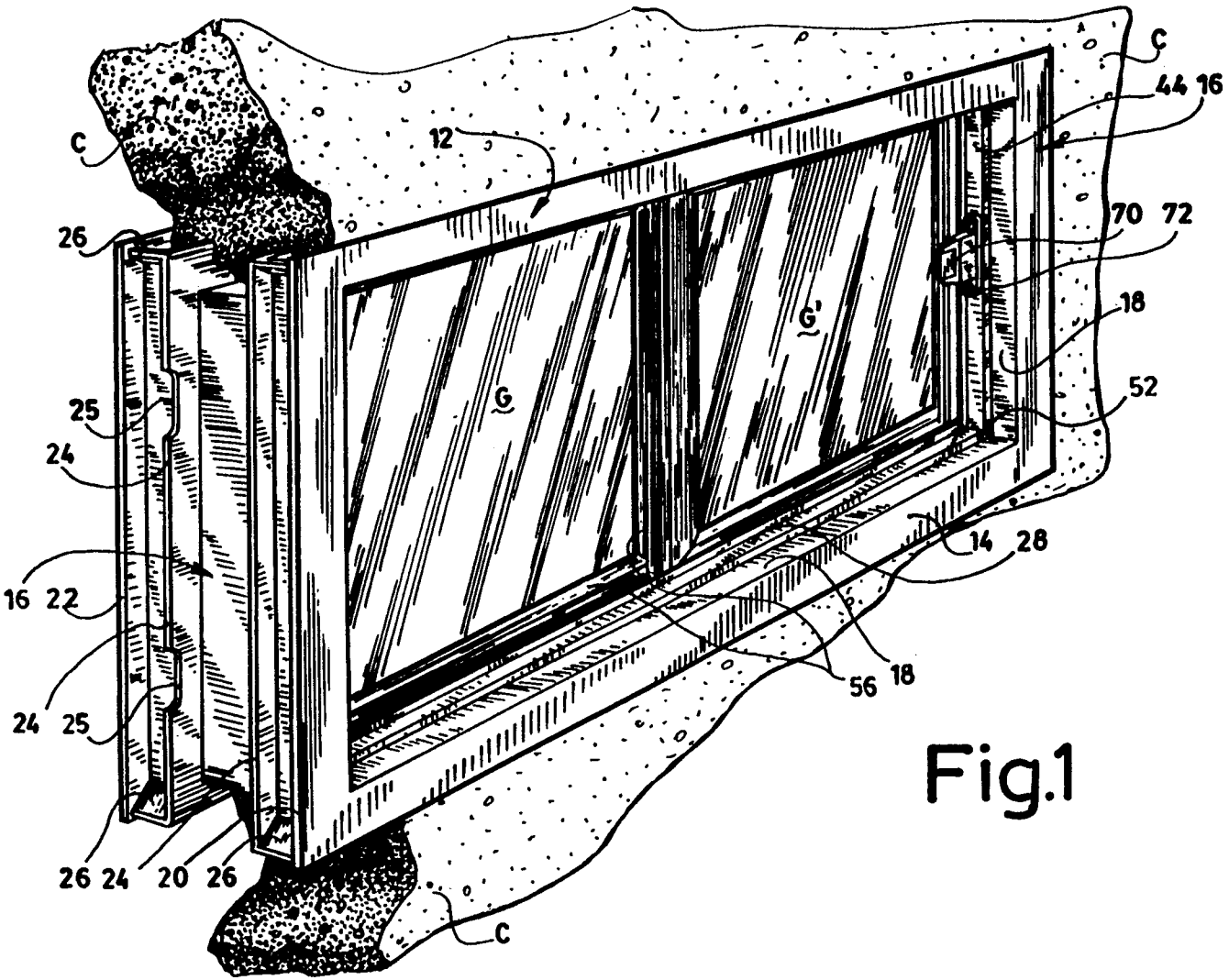
FIG. 1 is a perspective view of a cut-away basement concrete wall of a building, in which is embedded the buck frame of the invention, the buck frame fitted with a window assembly including the window frame of the invention, and horizontally slidable glazed sashes.

The buck frame 10 is made of a single rectangular piece, being molded of rigid plastic material. Buck frame 10 defines a lintel 12, a sill 14, and opposite jambs 16. Buck frame 10 forms an opening as defined by the inner face 18 of lintel 12, sill 14, and jambs 16. An interior flange 20 and an exterior flange 22 outwardly protrude from the lintel 12, sill 14, and jambs 16, all around the buck frame, and are arranged to be disposed at the exterior and interior surfaces of the concrete wall C respectively. These flanges, along with additional intermediate flanges 24, which are parallel to flanges 20 and 22 all around the buck frame, serve also to reinforce the buck frame against the weight of the freshly-poured concrete. Inclined corner partitions 26 extend between flanges 20 and 24 and also between flanges 22 and 24 at the four corners of the buck frame to reinforce these flanges. The flanges 24 of jambs 16 have notches 25 to facilitate handling of the buck frame 10 (FIG. 1).

A boss 28 inwardly protrudes from the inner faces 18 for each of the intel 12, sill 14, and jambs 16. Each boss 28 is coextensive with the corresponding lintel, sill and jambs. Each boss 28 is of generally channel-shape defining a flat bottom wall 30 and side steps 32 joining the bottom wall 30 with the inner face 18 on each side of the boss 28, the latter being centrally disposed transversely of the buck frame with respect to the flanges 20,22. the steps 32 being parallel to said flanges.

Figures 5, 6, 7, 8, 9, 10:
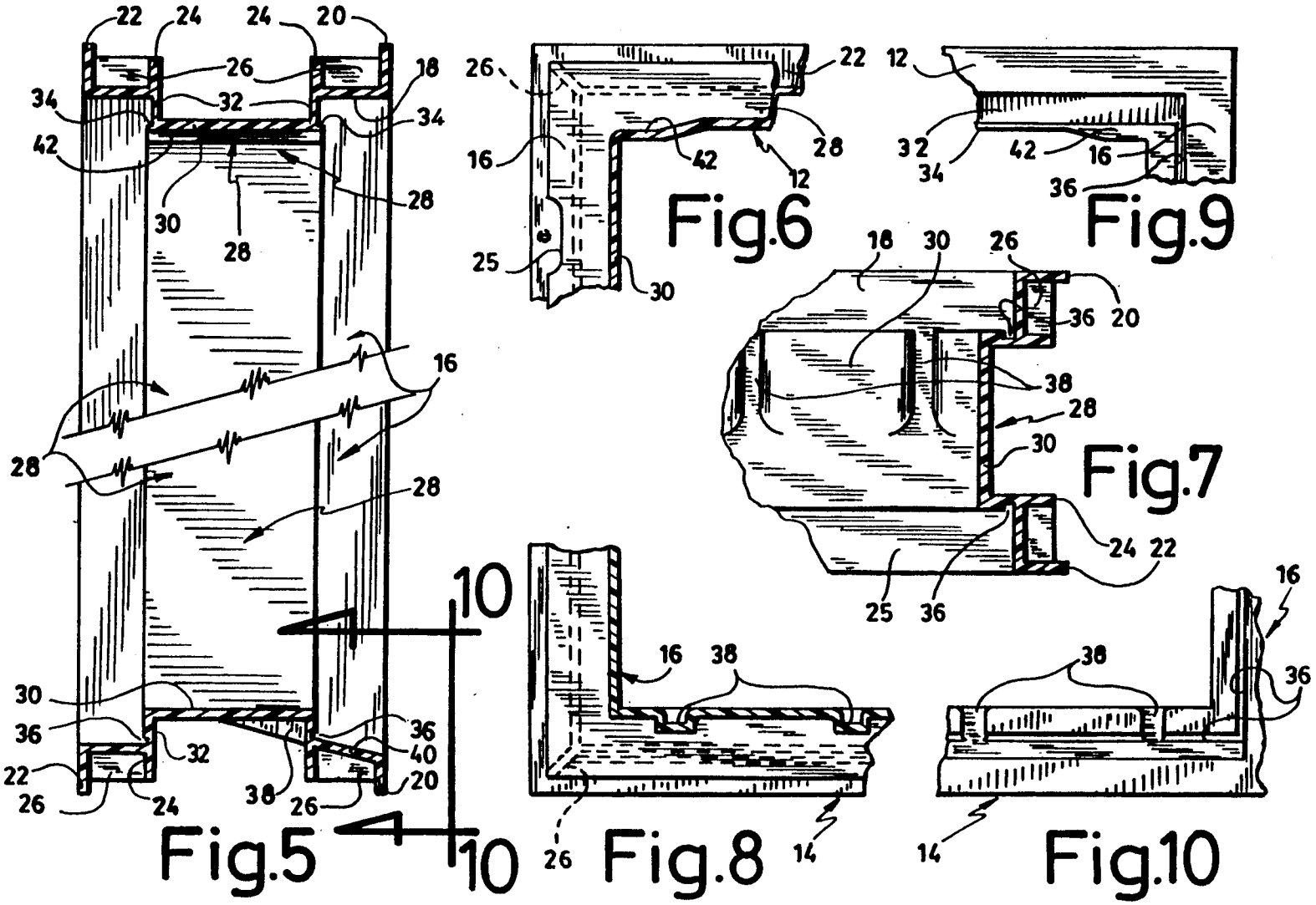
FIG. 5 is a broken, enlarged cross-section, taken along line 5—5 of FIG. 2.
FIG. 6 is a partial section, taken along line 6—6 of FIG. 3.
FIG. 7 is a partial plan section, taken along line 7—7 of FIG. 2.
FIG. 8 is a partial section, taken along line 8—8 of FIG. 3.
FIG. 9 is a partial elevation in area 9 of FIG. 2.
FIG. 10 is a partial front elevation, taken along line 10—10 of FIG. 5.

As shown in FIG. 5, the boss 28 of the lintel 12 is provided with window frame-retaining lips 34 protruding from the side steps 32 opposite bottom wall 30 and generally co-extensive with said bottom wall and inwardly spaced from the inner face 18 and parallel thereto.

The steps 32 of the boss running along the sill 14, and also of the bosses running along the jambs 16, as shown in FIGS. 7, 9, 10, are provided with window frame-retaining grooves 36 outwardly spaced from the bottom wall 30 of the corresponding bosses 28 and co-extensive with the corresponding sill and jambs and parallel to the corresponding bottom wall 30.

The bottom wall 30 of the boss 28 protruding from the sill 14, is provided with a series of water-draining troughs 38 (see FIGS. 5, 7, 8, and 10), which are downwardly inclined in the direction of the interior flange 20 and which open and merge with a similarly-inclined wall 40 defining the interior part of the inner face 18 of the sill 14. As shown in FIGS. 5, 6, and 9, the bottom wall 30 of the boss 28, made in the lintel 12, is provided at both ends thereof, with a slight inward ramp 42, the purpose of which will be explained hereinafter.

Figure 11:
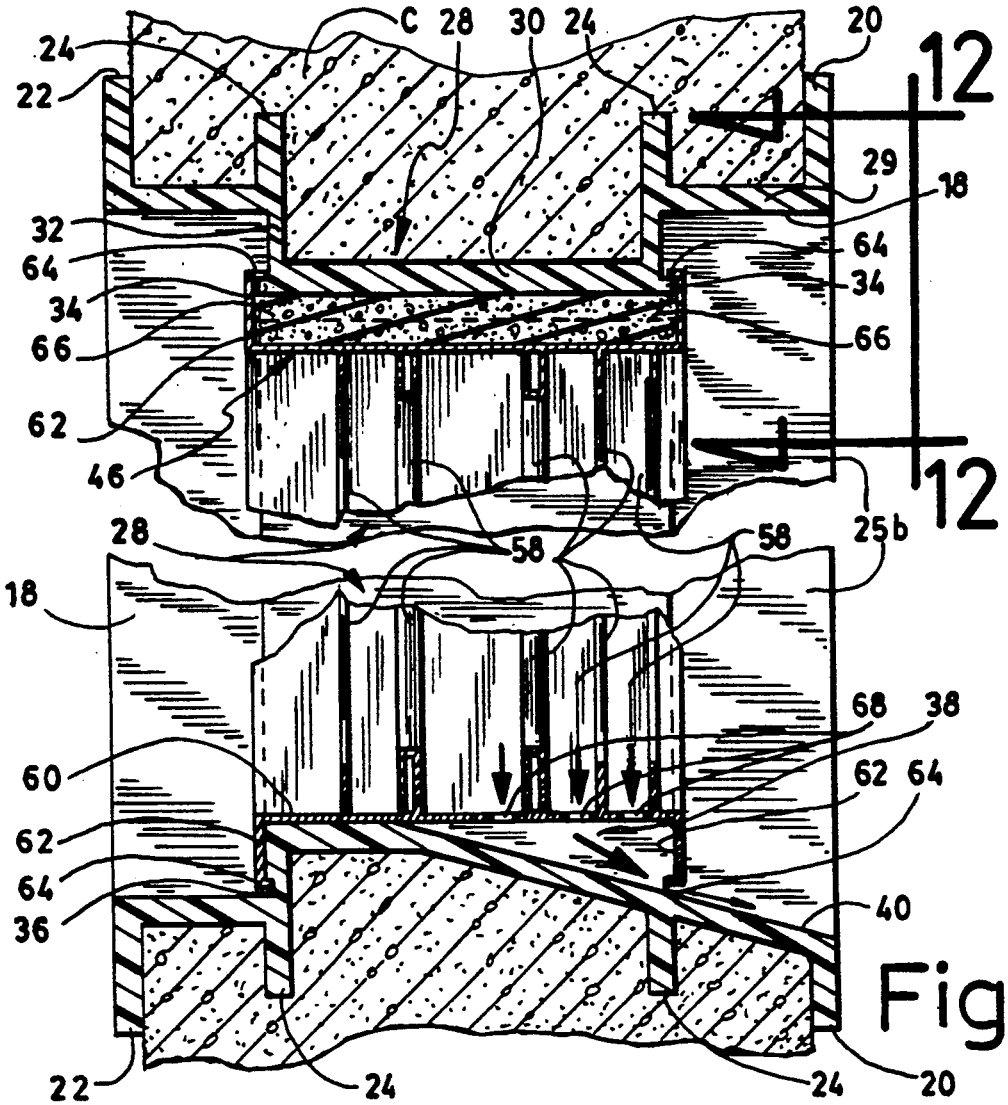
FIG. 11 is a broken cross-section of the buck frame embedded into concrete and of the window frame installed within the buck frame, the glass panes being removed.

The window frame of the invention is generally indicated at 44 and is composed of four separate parts: namely, a lintel part 46, a sill part 48, and two jamb parts 50, which can be joined two by two at their bevelled edges 52, as shown in FIG. 1. As shown in FIGS. 1 and 11, glass panes G,G' each fitted within a sash 56, are horizontally slidable between open and closed position within guiding tracks 58 formed in the window frame parts 46, 48 and 50, in conventional manner.

These parts 46, 48, and 50 are made of plastic extrusions having a channel shape defined by a web 60 and side legs 62, the outer free edge of the side legs 62 being provided with inturned hooking flanges 64.

Upon spreading apart of the side legs 62 of the lintel part 46, the hooking flanges 64 can clear the lips 34 and then, when released, snap back into hooking position, as shown in FIG. 11, to retain the lintel part 46 on the buck frame lintel 12. A band 66, of compressible material, such as polyurethane foam, is interposed between the window frame lintel part 46 and the buck frame lintel boss 28, and biases the lintel part 46 downwardly in a position in which the hooking flanges 64 rest against the lip 34. However, the lintel part 46 of the window frame can be raised while the band 66 compressed.

The sill part 48 of the window frame 44 is retained on the boss 28 of the buck frame sill 14 by means of the hooking flanges 64 engaging the grooves 36. In this position, as shown in FIG. 11, the web 60 rests against the inner face of the boss 28. Similarly, the window frame jamb parts 50 are retained by their hooking flanges 64, which releasably engage the grooves 36 in the buck frame jambs 16, said grooves being shown in FIGS. 7, 9, and 10.

The sill part 48 is provided with a plurality of drainage holes 68 in the bottom of the guiding tracks 58 and in register with the troughs 38, whereby condensation water dripping from the window panes 54 will fall through said holes within the troughs 38 and along the inclined wall 40.

Window latches 70 (see FIG. 1) serve to lock the sashes 56 in closed position, in conventional manner. The bolts 72 for fixing the latches 70 to the window frame, extend through said window frame and are screwed within lugs 74 (see FIGS. 3 and 4) integrally molded with the buck frame 10 at the appropriate locations in the jambs 16. Ramps 42 effect a better seal when the gazed sashes 56 are closed because of the greater compression of band 66 at its ends.

Figures 2, 3, 4:
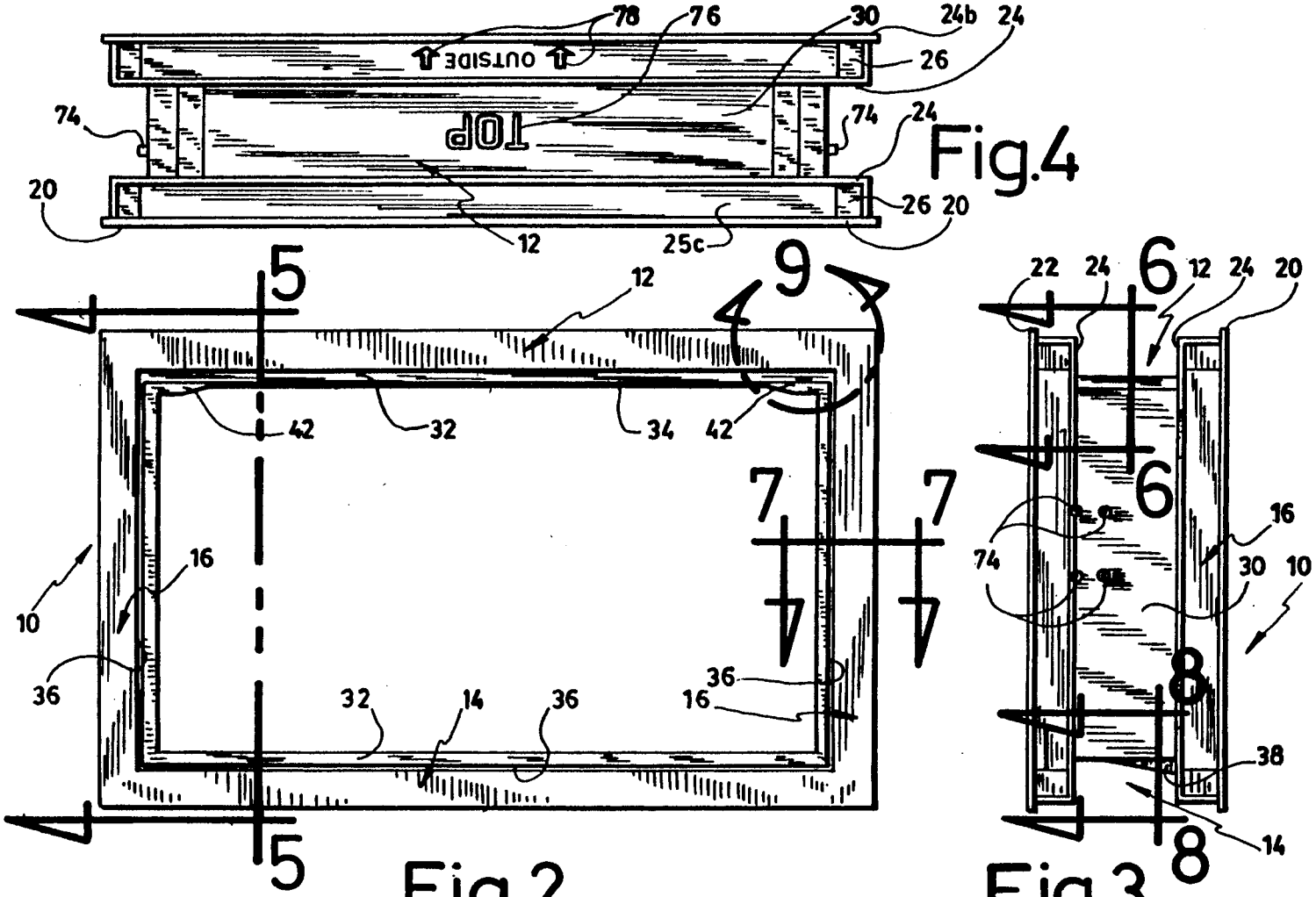
FIGS. 2, 3, and 4 are a front elevation, a side elevation, and a top plan view, respectively, of the buck frame.
Figure 12:
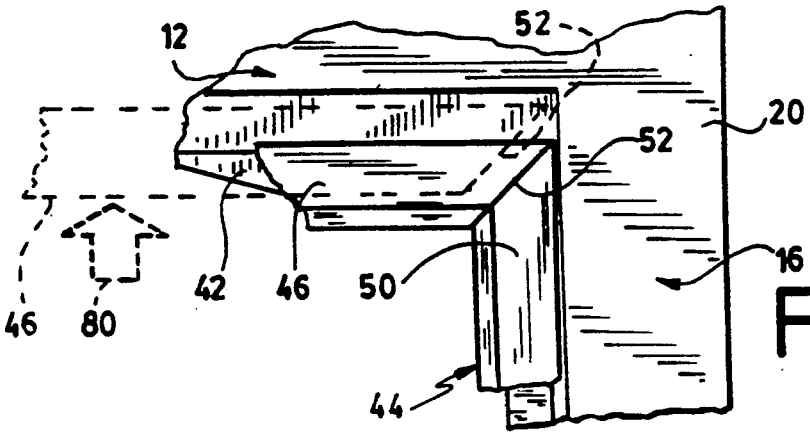
FIG. 12 is a partial front view, taken along line 12—12 of FIG. 11.

The buck frame 10 is inserted within the wall forms for pouring concrete, in the proper orientation, as indicated by the marking 76 and arrows 78, as shown in FIG. 4. If necessary, braces can be inserted within the buck frame opening to further resist weight of the freshly-poured concrete. However, this has generally not been found necessary. After the buck frame is embedded in the concrete, and the concrete is cured, and the wall forms removed, the window frame lintel part 46, together with the band 66 of compressible material, are releasably fitted within the buck frame. Then the sill part 48 is fitted and, by raising the lintel part 46, as shown by arrow 80 in FIG. 12, against the bias of the compressible band 66, it is possible to insert and fit the jamb parts 50. The glass panes G,G', with or without a sash 56, can be then installed within the guiding tracks 58 of the window frame 44 by lifting the lintel part 46. Whenever a glass pane 54, and/or a sash 56 or a part of the window frame 44 is broken, it is easy to remove the glass panes and also the window frame parts, for repairing and thereafter re-installation. Again, the lintel parts 46 are lifted as by arrow 80; the glass panes G,G' are removed; then the jamb parts, if necessary and, finally, the lintel part 46 and sill part 48.

I claim:

1. The combination of a buck frame and a window frame for a poured concrete wall having an exterior and an interior surface, said buck frame being rectangular, molded as a single piece and having four sides defining a lintel, jambs and a sill, each side including an exterior and an interior flange outwardly protruding from said buck frame and to be disposed at the exterior and interior surfaces of said wall, respectively, said lintel, jambs and sill each forming an inward and co-extensive boss, each boss defining an inner face and a pair of opposite steps, a lip protruding from and co-extensive with each step of the boss of said lintel and generally parallel to and substantially registering with the inner face of the boss of said lintel, each step of the boss of said jambs and of said sill having a groove parallel to and outwardly spaced from the inner face of the respective boss of said jambs and of said sill, said window frame being quadrangular, composed of four separate parts joinable two by two, said parts being a lintel part, two jamb parts and a sill part, each part defining a cross-sectionally U-shape channel receiving a corresponding boss of said buck frame, each channel defined by a web and a pair of legs, each leg having an inwardly-directed hooking flange along its free edge, the legs of said pair capable of being spaced apart, the hooking flanges of said window-frame jamb parts and sill part releasably engageable with the grooves of the bosses of said buck frame jambs and of said buck frame sill respectively, the hooking flanges of the window frame lintel part releasably hooking the lips of the boss of the buck frame lintel, and a band of compressible material sandwiched between the inner face of the boss of said buck frame lintel and the web of said window frame lintel part, said hooking flanges being released from said grooves or said lips by spreading apart the pair of legs from which said hooking flanges depend.

2. The combination as defined in claim 1, wherein the webs of said window frame sill and jamb parts rest flat against the inner faces of the corresponding buck frame sill and jamb bosses.

3. The combination as claimed in claim 1, wherein said window frame parts join together at the corners of said window frame by a 45-degree butt joint.

4. The combination as defined in claim 1, wherein said window frame parts have parallel tracks for receiving horizontally-slidable glass panes.

5. The combination as defined in claim 1, further including ribs outwardly protruding from said buck frame and integral therewith and parallel to said exterior and interior flanges and inwardly spaced therefrom transversely of said buck frame.

6. The combination as defined in claim 1, wherein the buck frame sill defines an inner surface which is downwardly inclined in the direction of said interior flange, and further including downwardly- and inwardly-inclined troughs made in the inner face of the boss of said butt frame sill, said troughs merging with said inclined face; and further including drainage openings made in the web of said window frame sill part, said openings in register with said troughs.

7. A buck frame for a poured concrete wall having an exterior and an interior surface of quadrangular shape, molded as a single piece and having four sides defining a lintel, a jamb and a sill, each side including an outwardly-protruding exterior and interior flange to be disposed at the exterior and interior surfaces of said wall, respectively, said buck frame having an inner face defining an aperture, said lintel, jambs and sill each forming an inwardly-extending co-extensive boss defining a boss inner face and a pair of opposite steps extending between said boss inner face and said buck frame inner face, said steps generally parallel to said flanges, each step of the boss of said lintel having a lip, generally parallel to said inner face of said buck frame and inwardly spaced therefrom, the step of the bosses of said jambs and of said sill having a groove parallel to and outwardly spaced from the inner face of said boss.

8. A buck frame as defined in claim 7, wherein said buck frame sill boss is provided with a series of draining troughs made in its inner face and downwardly inclined in the direction of the interior flange of said buck frame.

* * * * *